US009634398B2

(12) United States Patent
Liu et al.

(10) Patent No.: US 9,634,398 B2
(45) Date of Patent: Apr. 25, 2017

(54) CASSEGRAIN SATELLITE TELEVISION ANTENNA AND SATELLITE TELEVISION RECEIVING SYSTEM THEREOF

(75) Inventors: Ruopeng Liu, Shenzhen (CN); Chunlin Ji, Shenzhen (CN); Yutao Yue, Shenzhen (CN); Jinjin Wang, Shenzhen (CN); Yunnan Hong, Shenzhen (CN)

(73) Assignee: KUANG-CHI INNOVATIVE TECHNOLOGY LTD., Shenzhen (CN)

( * ) Notice: Subject to any disclaimer, the term of this patent is extended or adjusted under 35 U.S.C. 154(b) by 440 days.

(21) Appl. No.: 14/235,051

(22) PCT Filed: Nov. 17, 2011

(86) PCT No.: PCT/CN2011/082323

§ 371 (c)(1),
(2), (4) Date: Jan. 25, 2014

(87) PCT Pub. No.: WO2013/013453

PCT Pub. Date: Jan. 31, 2013

(65) Prior Publication Data

US 2015/0303584 A1 Oct. 22, 2015

(30) Foreign Application Priority Data

Jul. 26, 2011 (CN) ..... 2011 1 0210202
Jul. 26, 2011 (CN) ..... 2011 1 0210274
(Continued)

(51) Int. Cl.

| | |
|---|---|
| ***H01Q 19/06*** | (2006.01) |
| ***H01Q 15/10*** | (2006.01) |
| ***H01Q 15/00*** | (2006.01) |

(52) U.S. Cl.
CPC ..... *H01Q 19/062* (2013.01); *H01Q 15/0086* (2013.01); *H01Q 15/10* (2013.01)

(58) Field of Classification Search
None
See application file for complete search history.

(56) References Cited

U.S. PATENT DOCUMENTS 3,911,440 A * 10/1975 Mizusawa ..... H01Q 19/191 333/248
2008/0165079 A1* 7/2008 Smith ..... B82Y 20/00 343/911 R
2011/0069377 A1 3/2011 Wu et al.

FOREIGN PATENT DOCUMENTS

CN 101587990 A 11/2009
CN 101699659 A * 4/2010
(Continued)

*Primary Examiner* — Robert Karacsony
(74) *Attorney, Agent, or Firm* — Perkins Coie LLP

(57) ABSTRACT

The present invention discloses a Cassegrain satellite television antenna comprising a metamaterial plate. The metamaterial plate comprises a core layer. The core layer comprises core sublayers. Each core sublayer comprises a circular area and a plurality of annuli distributed around the circular area. According to the Cassegrain satellite television antenna of the present invention, the traditional parabolic antenna is replaced with a sheet-like metamaterial plate which is easier to process and has a lower cost. In addition, the present invention also provides a satellite television receiving system equipped with the above-mentioned Cassegrain satellite television antenna.

4 Claims, 14 Drawing Sheets

(30) Foreign Application Priority Data

Aug. 23, 2011 (CN) ..... 2011 1 0242555
Aug. 23, 2011 (CN) ..... 2011 1 0242683

(56) References Cited

FOREIGN PATENT DOCUMENTS

| | | | | |
|---|---|---|---|---|
| CN | 201450116 | U | | 5/2010 |
| CN | 101867094 | A | * | 10/2010 |
| JP | 2011112942 | A | | 6/2011 |

* cited by examiner

CASSEGRAIN SATELLITE TELEVISION ANTENNA AND SATELLITE TELEVISION RECEIVING SYSTEM THEREOF

FIELD OF THE INVENTION

The present invention relates to the field of communications, and in particular to a Cassegrain satellite television antenna and a satellite television receiving system thereof.

BACKGROUND OF THE INVENTION

The traditional satellite television receiving system refers to a satellite earth receiving station comprised of a parabolic antenna, a feed, a low-noise block downconverter, also called a low-noise block (LNB), and a satellite receiver. The parabolic antenna is intended to reflect satellite signals to the feed at the focal point of the antenna and to the LNB. The feed is a horn (also called a corrugated horn) located at the focal point of the parabolic antenna for receiving satellite signals. The feed has mainly two functions: one is to collect the electromagnetic waves received by the antenna, convert them into signal voltages, and then transmit them to the LNB; the other is to convert the polarization of the received electromagnetic waves. An LNB is used to downconvert satellite signals sent by the feed, amplify them, and then transmit them to a satellite receiver. Generally, LNBs can be divided into C-band frequency LNB (3.7 GHz-4.2 GHz, 18-21 V) and Ku-band frequency LNB (10.7 GHz-12.75 GHz, 12-14 V). An LNB amplifies high frequency satellite signals to hundreds of thousands of times larger, and then convert the amplified signals through a local oscillator circuit to an intermediate frequency (950 MHz-2050 MHz) so as to facilitate signal transmission through coaxial cables and demodulation by the satellite receiver. The satellite receiver demodulates the satellite signals passed by the LNB to satellite television images or audio and digital signals.

When receiving signals, a parabolic antenna reflects and converges the parallel electromagnetic waves to the feed. Normally, the feed of a parabolic antenna is a horn antenna.

However, manufacturing of parabolic antennas is complicated and costly because of great difficulties in and high precision requirements for processing the curve of a parabolic reflector.

SUMMARY OF THE INVENTION

In light of the shortcomings of difficult processing and high cost of the prior art satellite television antennas, the present invention aims to solve the above-mentioned technical problems. Thus the present invention provides a Cassegrain satellite television antenna which is easy to process and has a low cost.

The technical solution that the present invention employs to solve the technical problems is: A Cassegrain satellite television antenna. The Cassegrain satellite television antenna comprises a metamaterial plate which is located in front of the feed. The metamaterial plate comprises a core layer. The core layer comprises at least one core sublayer. The core sublayer comprises a sheet-like substrate and a plurality of artificial microstructures or artificial pore structures located on/in the substrate. The core sublayer can be divided into two parts according to refractive index distributions, with one part being a circular area which is in the center of the core sublayer, and the other part being a plurality of annuli which are distributed around and share the same center with the circular area. The refractive indexes of points at the same radius in the circular area and the annuli are the same and decrease with the increase of radius. The minimum value of the refractive index in the circular area is smaller than the maximum value of the refractive index in the adjacent annulus. In two adjacent annuli, the minimum value of the refractive index in the inner annulus is smaller than the maximum value of the refractive index in the outer annulus.

Further, the core sublayer also comprises a filler layer covering the artificial microstructures.

Further, the core layer comprises a plurality of parallel core sublayers with the same refractive index distribution.

Further, the metamaterial plate also comprises matching layers located on both sides of the core layer so as to match the refractive index from air to the core layer.

Further, the center is the center of the core sublayer. The refractive index change ranges in the circular area and annuli are the same. The distribution of the refractive index in the core sublayer is given by the following equation:

$$n(r) = n_{max} - \frac{\sqrt{l^2 + r^2} - l - k\lambda}{d}$$

wherein, n(r) is the refractive index at a point on the core sublayer whose radius is r;

l is the distance from the feed to its nearby matching layer, or the distance from the feed to the core layer;

d is the thickness of the core layer, $$d = \frac{\lambda}{n_{max} - n_{min}};$$

$n_{max}$ is the maximum value of the refractive index on the core sublayer;

$n_{min}$ is the minimum value of the refractive index on the core sublayer; and $$k = \text{floor}\left(\frac{\sqrt{l^2 + r^2} - l}{\lambda}\right),$$

wherein floor indicates rounding down to the nearest integer.

Further, the matching layer comprises a plurality of matching sublayers. Each matching sublayer has a single refractive index. The refractive indexes of the matching sublayers on both sides of the core layer are given by the following equation:

$$n(i) = ((n_{max} + n_{min})/2)^{\frac{i}{m}};$$

wherein, m is the total amount of matching layers, and i is the serial number of a matching sublayer, where the serial number of the matching sublayer adjacent to the core layer is m.

Further, each matching sublayer comprises a first substrate and a second substrate which are made from the same material. The space between the first substrate and the second substrate is filled with air.

Further, the artificial microstructures of each core sublayer are of the same shape. The artificial microstructures at the points at the same radius in the circular area and annuli are of the same physical dimensions. The physical dimensions of the artificial microstructures at the points gradually decrease as the radius of the points increases in the circular area or annuli. The physical dimensions of the minimum artificial microstructures in the circular area are smaller than those of the maximum artificial microstructures in the adjacent annulus. In two adjacent annuli, the physical dimensions of the minimum artificial microstructures in the inner annulus are smaller than those of the maximum artificial microstructures in the outer annulus.

Further, the artificial pore structures of each core sublayer are of the same shape, and the artificial pore structures are filled with a medium whose refractive index is larger than that of the substrates. The artificial pore structures at the points at the same radius in the circular area and annuli are of the same volume and the volumes of the artificial pore structures gradually increase as the radius of the points increases in the circular area and annuli. The volume of the minimum artificial pore structure in the circular area is smaller than the volume of the maximum artificial pore structure in the adjacent annulus. In two adjacent annuli, the volume of minimum artificial pore structure in the inner annulus is smaller than the volume of the maximum artificial pore structure in the outer annulus.

Further, the artificial pore structures of each core sublayer are of the same shape, and the artificial pore structures are filled with a medium whose refractive index is smaller than that of the substrates. The artificial pore structures of the points at the same radius in the circular area and annuli are of the same volume and the volumes of the artificial pore structures of the points gradually increase as the radius of the points increases in the circular area or annuli. The volume of the maximum artificial pore structure in the circular area is larger than the volume of the minimum artificial pore structure in the adjacent annulus. In two adjacent annuli, the volume of the maximum artificial pore structure in the inner annulus is larger than the volume of the minimum artificial pore structure in the outer annulus.

Further, the artificial microstructure is a snowflake-shaped metal microstructure.

Further, the artificial pore structure is a cylindrical pore.

Further, the Cassegrain television antenna comprises a diverging component located in front of the feed which is capable of diverging electromagnetic waves. The metamaterial plate is located in front of the diverging component. The diverging component is a concave lens or a diverging metamaterial plate. The diverging metamaterial plate comprises at least a diverging sublayer. The refractive index of the diverging sublayer is distributed over a circle, with the center of the diverging sublayer as the center of the circle. The refractive indexes of two points at the same radius are the same. The refractive indexes decrease with the increase of the radius.

According to the Cassegrain satellite television antenna of the present invention, the traditional parabolic antenna is replaced with a sheet-like metamaterial plate. The sheet-like metamaterial plate is easier to process and has a lower cost.

Besides, the present invention also provides a satellite television receiving system which comprises a feed, an LNB and a satellite receiver. The satellite television receiving system also comprises a foregoing Cassegrain satellite television antenna which is located in front of the feed.

BRIEF DESCRIPTION OF THE DRAWINGS

To illustrate the technical solutions in the embodiments of the present invention more clearly, the following briefly introduces the accompanying drawings required for the description of the embodiments. Apparently, the accompanying drawings in the following description are merely some rather than all embodiments of the present invention and a person of ordinary skill in the art may still derive other drawings from these accompanying drawings without creative efforts. Where.

DETAILED DESCRIPTION

Figure 1:
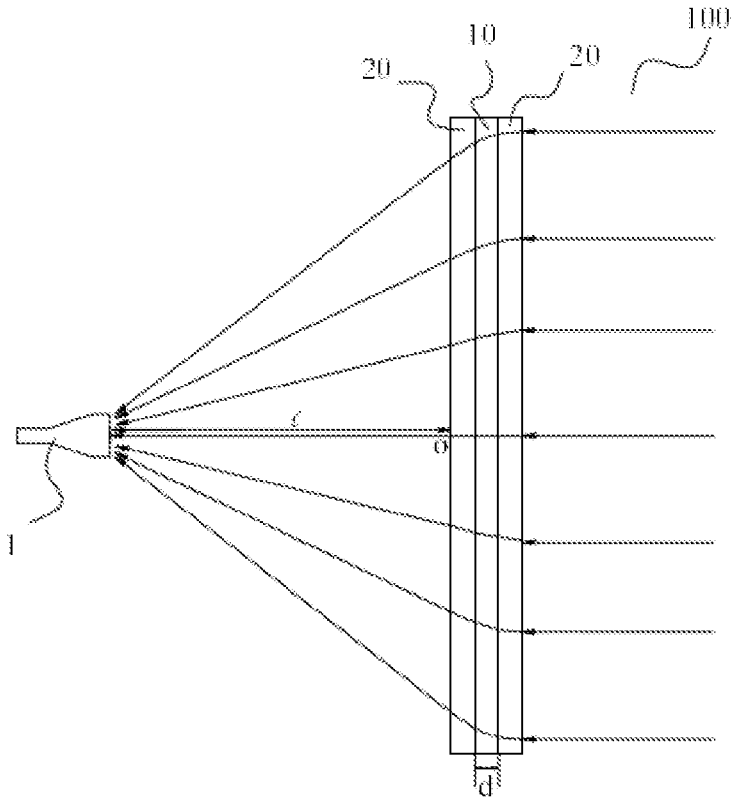
FIG. 1 is a schematic view of the structure of a Cassegrain satellite television antenna according to a first embodiment of the present invention.

The content of the present invention is described in detail with reference to the accompanying drawings.

As shown in FIG. 1 to FIG. 7, a Cassegrain satellite television antenna according to a first embodiment of the present invention comprises a metamaterial plate 100 in front of feed 1. The metamaterial plate 100 includes a core layer 10. The core layer 10 comprises at least one core sublayer 11. The core sublayer 11 comprises a sheet-like substrate 13 and a plurality of artificial microstructures 12 arranged on the substrate 13 (referring to FIG. 2*a*). Based on refractive index distribution, the core sublayer 11 is divided into a circular area Y in the center and a plurality of annuli (H1, H2, H3, H4 and H5 as shown in FIG. 2*b*) which are distributed around and share the same center with the circular area Y The refractive indexes of points at the same radius in the circular area Y and the annuli are the same and gradually decrease as the radius increases. The minimum refractive index of the circular area Y is smaller than the maximum refractive index of its neighboring annulus. In two annuli adjacent to each other, the minimum refractive index of the inner annulus is smaller than the maximum refractive index of the outer annulus. The core sublayer 11 is divided into a circular area and a plurality of annuli according to refractive index in order to better explain the present invention, not necessarily to indicate the actual existence of this structure in the core sublayer 11. In the present invention, the feed 1 is situated at the central axis of the metamaterial plate, which means that the line linking the feed with the core sublayer 11 coincides with the central axis of the metamaterial plate. Conventional brackets can be used to support the feed 1 and the metamaterial plate 100, but since brackets are not essentials to the present invention, they are not included in the drawing. Preferably, the feed is horn antenna. Annuli here refer to both the complete annuli and the incomplete annuli in FIG. 3. The core sublayer 11 is square in the drawing. Of course, it may also take other shapes, for example, cylinder. When the core sublayer 11 is cylindrical, all the annuli may be complete annuli. In addition, annuli H4 and H5 are not essentially necessary in FIG. 3, and when they are left out, the areas of H4 and H5 will be characterized by uniform refractive index distribution, which means no artificial microstructure exists in the areas of H4 and H5.

As shown in FIG. 1 to FIG. 4, the core layer 10 comprises a plurality of parallel core sublayers 11 with identical refractive index distribution. The plurality of core sublayers 11 are tightly connected either by double-sided tape or by using bolts. In addition, the core sublayer 11 also comprises a filler layer 15 which covers the artificial microstructure 12. The material of the filler layer 15 may be air or other dielectric plates, but preferably plate-shaped parts of the same material as used in substrate 13. Each core sublayer 11 can be divided into a plurality of the same metamaterial units D. Each metamaterial unit D consists of an artificial microstructure 12, a unit substrate V and a unit filler layer W. Each core sublayer 11, in the thickness direction, has only one metamaterial unit D. In addition, whether it is a cube or a cuboid, every metamaterial units D can be identical blocks with its length, width and height not greater than one fifth of the incident electromagnetic wave length (typically, one tenth of the incident electromagnetic wave length) so that the entire core layer could achieve continuous electric and/or magnetic field responses. Preferably, the metamaterial unit D is a cube with its side-length one tenth of the incident electromagnetic wave length. Certainly, the thickness of the filler layer can be adjusted and its minimum can be as low as zero, which means no filler layer is needed. In this case, the substrate and the artificial microstructure form the metamaterial unit, and the thickness of the metamaterial unit D equals to the sum of the thickness of unit substrate V and the thickness of the artificial microstructure. However, the preferred thickness of the metamaterial unit D should be one tenth of the incident electromagnetic wave length. The greater the thickness of the substrate V means the lower the thickness of filler layer W when the thickness of metamaterial unit D is set to one tenth of the incident electromagnetic wave length. Preferably, the unit substrate V and the unit filler layer W have the same thickness as shown in FIG. 2*a* and are made of the same material.

The artificial microstructure 12 is preferably a metal microstructure consisting of one or a plurality of metal wires. The metal wire is of certain width and thickness itself. The metal microstructure of the present invention is preferably a metal microstructure with isotropic electromagnetic parameters, just as the planar snowflake-shaped metal microstructure as shown in FIG. 2*a*.

For a planar artificial microstructure, isotropy means that the electric field and magnetic field responses, namely the permittivity and magnetic permeability, are the same for the microstructure in the plane when it receives any electromagnetic waves incident at any angles with respect to the two-dimensional plane. For a three-dimensional artificial microstructure, isotropy means that the electric field and magnetic field responses, namely the permittivity and magnetic permeability, are the same for the microstructure in the three-dimensional space when it receives electromagnetic waves from any directions in the three-dimensional space. When the artificial microstructure is of 90-degrees rotation symmetric shape, it enjoys isotropic characteristics.

For a two-dimensional structure on a plane, 90-degrees rotation symmetry means that the structure we get after it rotates 90 degrees around the rotation axis (perpendicular to the plane and passing through the center of symmetry of the structure) coincides with the original structure. For a three-dimensional structure, if we could find three rotation axes (perpendicular to each other and sharing a common intersection, which could serve as the rotation center), and the structure we get after it rotates 90 degrees around any of the three rotation axes coincides with the original structure or is symmetrical with the original structure over an interface, then it is a 90-degrees rotation symmetric structure.

Figure 2A:
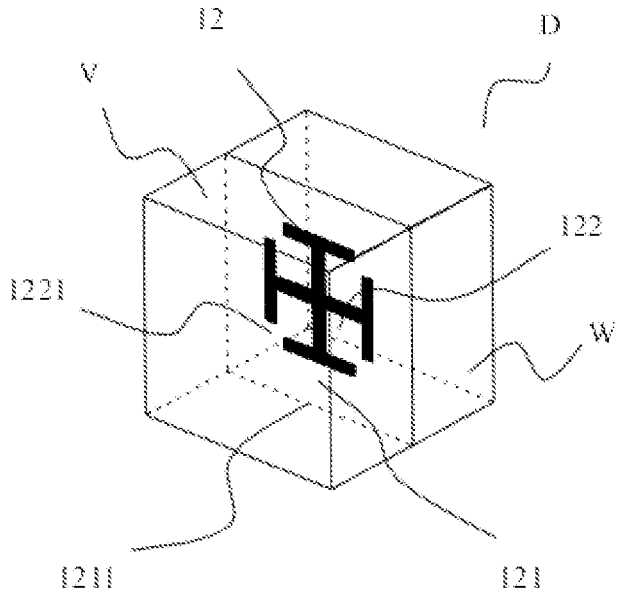
FIG. 2*a* and FIG. 2*b* are the isometric views of two structures of metamaterial units according to a first embodiment of the present invention.

The planar snowflake-shaped metal microstructure as shown in FIG. 2*a* is just one kind of isotropic microstructure. The metal microstructure comprises a first metal wire 121 and a second metal wire 122 which are perpendicular to each other and divide each other into two identical halves. Two distal ends of the first metal wire 121 respectively connect the middle of two metal wire branches 1211, which are of the same length. Two distal ends of the second metal wire 122 respectively connect the middle of two metal wire branches 1221, which are of the same length. The refractive index is given by the equation: $n=\sqrt{\mu\in}$, wherein $\mu$ is relative magnetic permeability and $\in$ is relative permittivity (collectively known as electromagnetic parameters). Experiments have proven that when travelling through a medium with refractive indexes unevenly distributed, electromagnetic waves will refract towards the direction with a larger refractive index (that is, towards the metamaterial unit with a larger refractive index). Therefore, the core layer of the present invention has an effect of converging electromagnetic waves. An appropriate design of the refractive index distribution of the core layer helps converge the electromagnetic waves emitted from the satellite to the feed after the electromagnetic waves passed through the core layer. When the materials for the substrate and the filler layer are decided, the refractive index of each metamaterial unit can be designed according to the distribution of internal electromagnetic parameters of metamaterial, which can be obtained by designing the shape and size of the artificial microstructures and/or the layout of the artificial microstructures on the substrate. First, the spatial layout of internal electromagnetic parameters (that is, the electromagnetic parameters of each metamaterial unit) of the metamaterial is calculated according to the effects to be achieved by the metamaterial. Then, according to the calculated spatial layout of the electromagnetic parameters, the shape and size (data of various artificial microstructures are stored in the computer beforehand) of artificial microstructure on each metamaterial unit are selected. Method of exhaustion can be used to design each metamaterial unit. For example, an artificial microstructure with a specific shape is selected and its electromagnetic parameters are calculated and compared with the desired one. This process is repeated until the desired electromagnetic parameters are found. If the desired electromagnetic parameters are found, selection of the design parameters of the artificial microstructure is finished. Otherwise, another artificial microstructure with a different shape is selected instead. The above process is repeated until desired electromagnetic parameters are found. The above process will not stop if desired electromagnetic parameters are not found. That is, the program stops only when the artificial microstructure with the desired electromagnetic parameters is found. As this process is executed by a computer, though seemed complex, it can be done quickly.

The metal microstructure 12 is made from metal wires such as copper wires or silver wires. These metal wires can be attached to the substrate by employing such methods as etching, plating, drilling, photolithography, electronic engraving or ion engraving. Certainly, three-dimensional laser processing technique can also be adopted.

FIG. 1 is a schematic drawing of the metamaterial plate in the first embodiment of the present invention. In this embodiment, the above mentioned metamaterial plate also comprises matching layers 20 arranged at opposite sides of the core layer to achieve matching of the refractive index from air to the core layer 10. As is known to all, the larger the refractive index difference between mediums, the greater the reflection from one medium to another and the energy loss will be. In this case, we need to match the refractive index between mediums. The refractive index is given by the equation: $n=\sqrt{\mu\in}$, wherein μ is relative magnetic permeability and ∈ is relative permittivity (collectively known as electromagnetic parameters). The refractive index of air is 1, as is known to all. In designing the matching layer, the refractive index of the matching layer on the side of the incident electromagnetic wave adjacent to air can have a refractive index basically the same as the refractive index of air, while on the side adjacent to the core layer the refractive index of the matching layer can be basically the same as the refractive index of the core sublayer. The matching layer on the exit side of the electromagnetic wave can be designed symmetric about the core layer. In this way, the matching of refractive index in the core layer is achieved and reflection of the electromagnetic wave can be reduced, resulting in great decreases in energy loss and longer distance transmission of electromagnetic waves.

Figure 3:
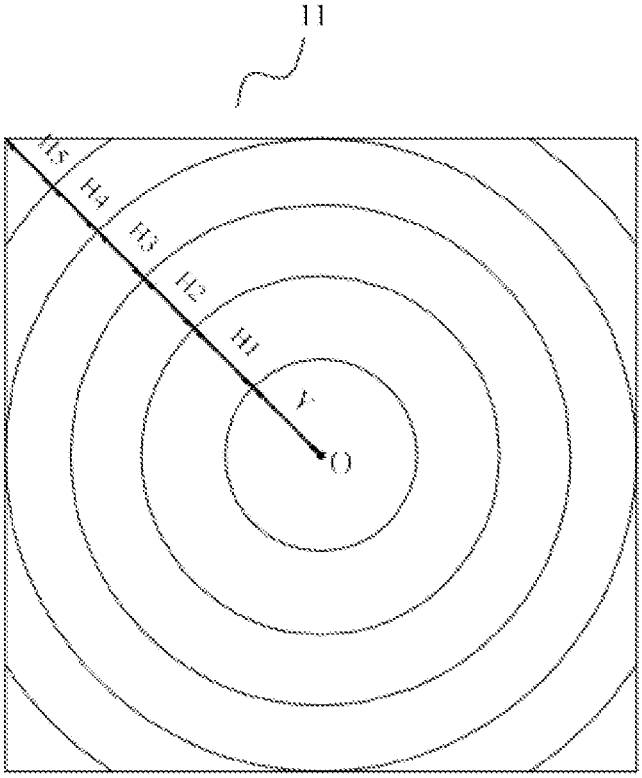
FIG. 3 is a schematic view of the refractive index distribution of a core sublayer according to a first embodiment of the present invention.

In this embodiment, as shown in FIG. 1 and FIG. 3, the center of the circular area Y is situated at center O of the core sublayer 11 and shares the same range of refractive index with a plurality of annuli. The distribution of refractive index n(r) of the core sublayer 11 is given by the following equation:

$$n(r) = n_{max} - \frac{\sqrt{l^2 + r^2} - l - k\lambda}{d}; \tag{1}$$

wherein n(r) is the refractive index of places with a radius r on the core sublayer (that is, the refractive index of metamaterial unit on the circle with a radius r). The radius here refers to the distance from the center of each unit substrate V to the center O (center of the circle) of the core sublayer. The center of unit substrate V refers to the center of a surface where the unit substrate V and the center O are situated.

l is the distance between feed 1 and its neighboring matching layer 20;

d is the thickness of the core layer $$d = \frac{\lambda}{n_{max} - n_{min}}; \tag{2}$$

$n_{max}$ is the maximum value of the refractive index of the core sublayer 11;

$n_{min}$ is the minimum value of the refractive index of the core sublayer 11;

The circular area Y and a plurality of annuli share the same range of refractive index change, which means that the refractive index of the circular area Y and the plurality of annuli decrease continuously from $n_{max}$ to $n_{min}$ from the inside to the outside. For example, if the value of $n_{max}$ is 6 and the value of $n_{min}$ is 1, the refractive index of the circular area Y and the plurality of annuli change continuously from 6 to 1 from the inside to the outside.

$$k = \text{floor}\left(\frac{\sqrt{l^2 + r^2} - l}{\lambda}\right), \tag{3}$$

wherein floor indicates rounding down to the nearest integer; k indicates the serial number of the circular area and annuli. When k=0, it indicates a circular area; when k=1, it indicates the first annulus adjacent to the circular area; when k=2, it indicates the second annulus adjacent to the first annulus; the rest can be deduced in the same way. That is to say, the maximum value of r will determine the number of annuli. As the thickness of each core sublayer usually has a certain value (typically, one tenth of the incident electromagnetic wave length), the size of the core sublayer can be determined based on the shape of the core layer (cylinder or square).

Core layer 10 as determined by equation (1), equation (2) and equation (3) can converge electromagnetic waves transmitted from satellites to the feed. This can be obtained by employing computer simulation or principle of optics (that is, calculation of equal optical paths).

In this embodiment, the thickness of the core sublayer 11 is definite, usually lower than one fifth and preferably one tenth of the incident electromagnetic wave length λ. In this way, the thickness d of the core layer is determined when the number of core sublayers 11 is decided. Therefore, if proper values of $n_{max}-n_{min}$ are set for Cassegrain satellite television antennas with different frequencies (wavelengths are different), any Cassegrain satellite television antenna of a desired frequency can be obtained according to equation (2). Take C-band and Ku-band for an example, the frequency range for C-band is 3400 MHz-4200 MHz, while the frequency range for Ku-band is 10.7-12.75 GHz which can be further divided into 10.7 GHz-11.7 GHz, 11.7 GHz-12.2 GHz, 12.2 GHz-12.75 GHz and other frequency ranges.

As shown in FIG. 1, in this embodiment, the matching layer 20 comprises a plurality of matching sublayers 21, all of which share the same refractive index. The refractive indexes of the plurality of matching sublayer on both sides of the core layer are given by the following equation:

$$n(i) = ((n_{max} + n_{min})/2)^{\frac{i}{m}}; \tag{4}$$

wherein, m is the total number of the matching layers and i is a serial number of the matching sublayer, where the serial number of the matching sublayer adjacent to the core layer m. From equation (4), it is clear that refractive indexes of the plurality of matching sublayers on one side of the core layer 10 are symmetrical with refractive indexes of the matching sublayers on the other side of the core layer 10. The total number (m) of the matching sublayers is directly related to the maximum refractive index and minimum refractive index $n_{min}$. When i=1, the refractive index of the first layer is obtained, and it is basically the same as the refractive index of air (1). Therefore, when the values of $n_{max}$ and $n_{min}$ are decided, the total number of the matching sublayers (m) can be obtained.

Figure 7:
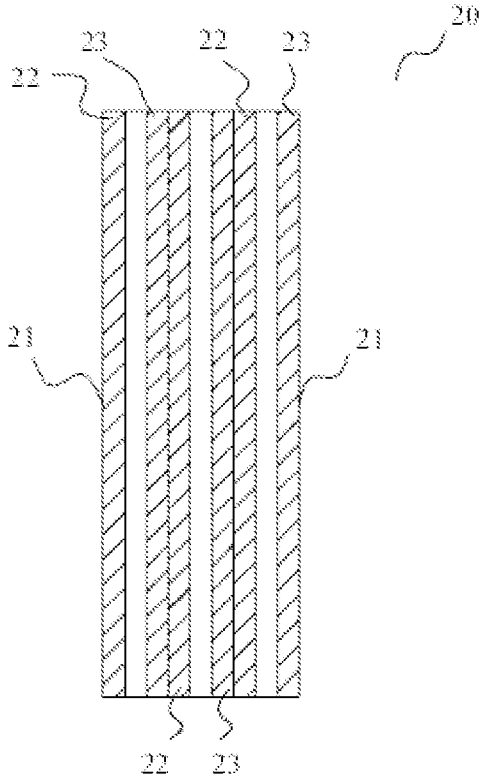
FIG. 7 is a schematic view of the structure of a matching layer according to a first embodiment of the present invention.
Figure 8:
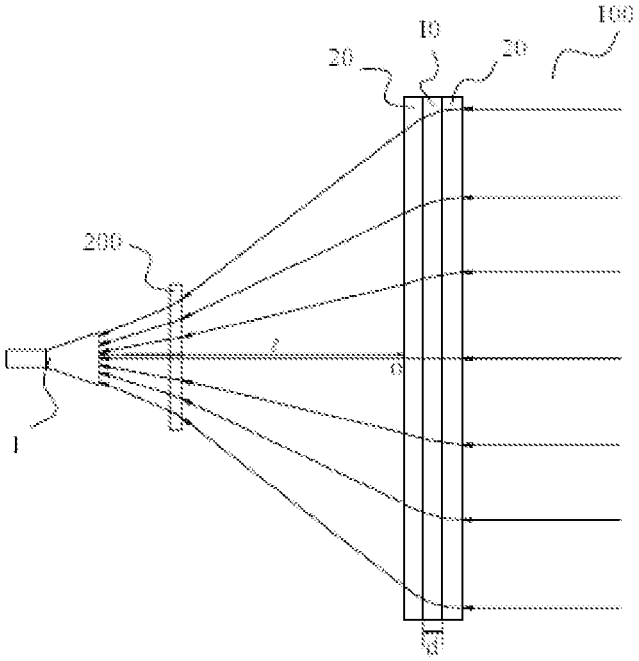
FIG. 8 is a schematic view of the structure of a Cassegrain satellite television antenna according to a second embodiment of the present invention.

The matching layer 20 may be formed out of a plurality of materials with a single refractive index in the natural world, or could be the kind of matching layer comprising a plurality of the matching sublayers 21 as shown in FIG. 7. Each matching sublayer 21 comprises the first substrate 22 and the second substrate 23 which are made of the same material, and the space between the first substrate 22 and the second substrate 23 is filled with air. By controlling the proportion between the volume of air and volume of the matching sublayer 21, it is possible to change refractive index from 1 (the refractive index of air) to the refractive index of the first substrate, thereby working out the refractive index of each matching sublayer properly and bringing about the matching of refractive index between air and the core layer.

Figure 4:
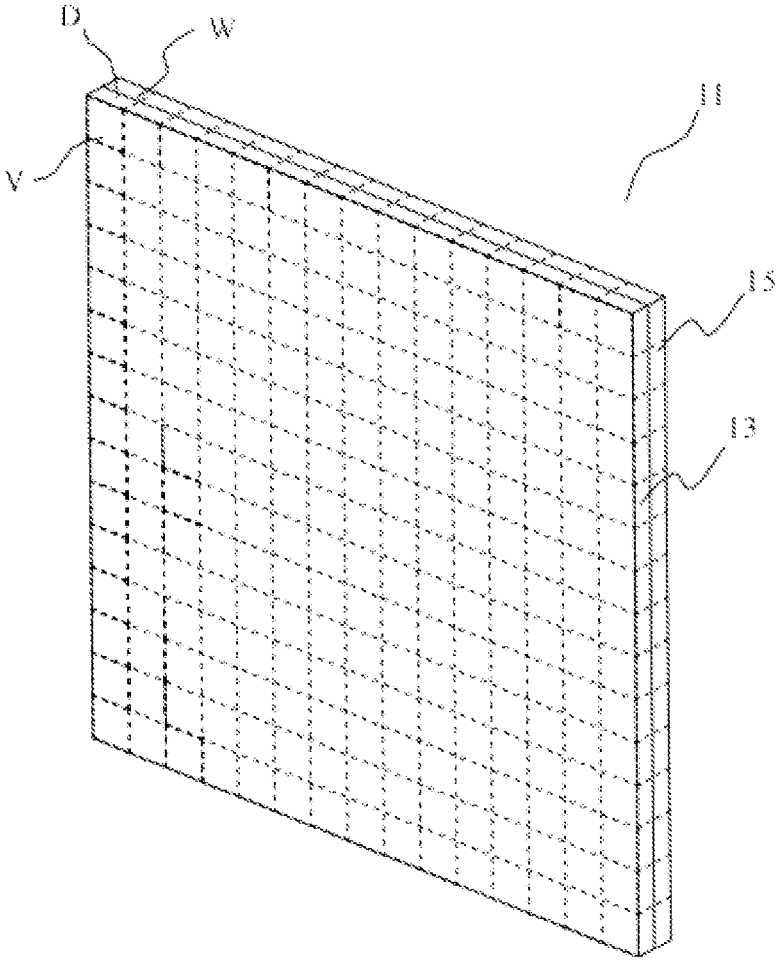
FIG. 4 is a schematic view of the structure of a form of a core sublayer according to a first embodiment of the present invention.

FIG. 4 is one form of the core sublayer 11. Each of the core sublayers 11 comprises a plurality of artificial microstructures 12 with the same shape which is a kind of planar snowflake-shaped metal microstructure. The center of each metal microstructure coincides with the center of the unit substrate V. The artificial microstructures at the same radius in the circular area and annuli are of the same physical dimensions. In each circular area and annulus, the physical dimensions of the artificial microstructure 12 decreases gradually with the increase of radius. The physical dimension of the smallest artificial microstructure in the circular area is smaller than the physical dimension of the largest artificial microstructure in the annulus adjacent to the circular area. In two neighboring annuli, the physical dimension of the smallest artificial microstructure in the inner annulus is smaller than the physical dimension of the largest artificial microstructure in the outer annulus. As the refractive index of each metamaterial unit decreases gradually with the decrease of the physical dimensions of that metal microstructure, the larger the physical dimension of an artificial microstructure, the larger its refractive index. Therefore, it is possible to realize the kind of refractive index distribution in the core sublayers as described in equation (1).

Core layer 10 may comprise the core sublayers 11 as shown in FIG. 4 with the actual number of sublayers varying from one to another, depending on the specific need (For instance, different electromagnetic waves) and the actual design needs.

Figure 2B:
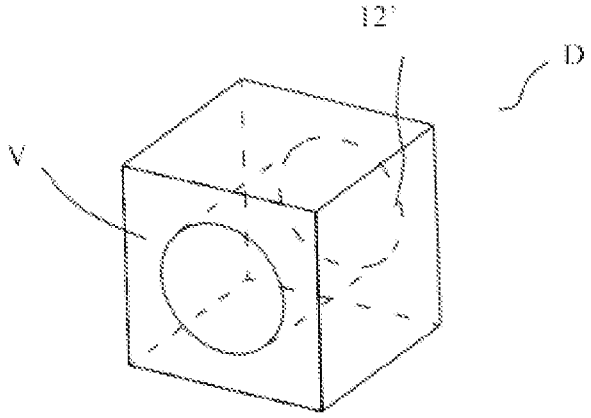

Referring to FIG. 2*b*, as an alternative to the first embodiment of the present invention, the microstructure 12 arranged on the substrate 13 is replaced with a plurality of artificial pore structures 12'. Based on refractive index distribution, the core sublayer 11 is divided into a circular area Y in the center and a plurality of annuli (H1, H2, H3, H4 and H5 as shown in FIG. 2*b*), which surround the circular area Y and share a common center with the circular area. Positions at the same radius in circular area Y and the annuli share the same refractive index. The refractive index decreases gradually with the increase of radius in each of the circular area and the annuli. The minimum refractive index of the circular area is smaller than the maximum refractive index of its neighboring annulus. In two adjacent annuli, the minimum refractive index of the inner annulus is smaller than the maximum refractive index of the outer annulus.

The artificial pore structure 12' can be formed on the substrate through high temperature sintering, injection molding, stamping or NC drilling. The artificial pore structure 12' can be formed by different methods with different substrate materials. For instance, when a ceramic material is chosen as the substrate, the artificial pore structure 12' is preferably formed through high temperature sintering. When a Polymer material of PTFE or Epoxy is chosen as the substrate, the artificial pore structure 12' is preferably formed through injection molding or stamping.

The artificial pore structure 12' can be cylindrical, conical, frustoconical, trapezoidal or square or a combination of the above-mentioned shapes. It can also take other forms. The shape of artificial pore structures 12' in metamaterial units D may be the same or may be different from each other, depending on the specific need. Certainly, in order to facilitate processing and manufacturing, the entire metamaterial preferably uses holes or bores of the same shape.

Figure 5:
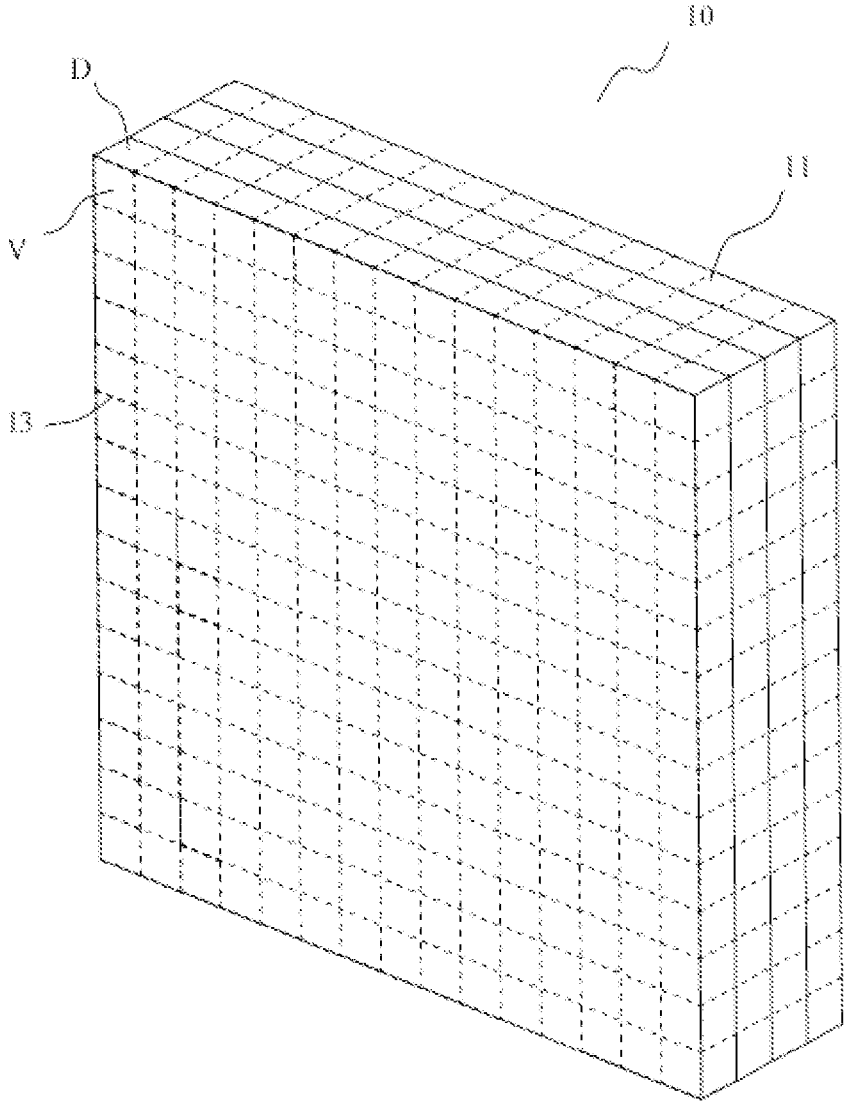
FIG. 5 is a schematic view of the structure of a second form of a core layer according to a first embodiment of the present invention.

Referring to FIG. 5, another structure of the core layer from the first embodiment of the present invention is shown. The core layer 10 includes a plurality of parallel core sublayers 11 with identical refractive index distribution. These sublayers 11 are tightly connected either by double-sided tape or by using bolts. In addition, there may be a space between two neighboring core sublayer 11, and these spaces are filled with air or other mediums so as to improve the performance of the core layer. The substrate 13 on each core sublayer 11 can be divided into a plurality of identical substrate units V, each of which defines an artificial pore structure 12'. Each substrate unit V and its corresponding artificial pore structure 12' form a metamaterial unit D, and the thickness of each core sublayer 11 is the same as the thickness of metamaterial unit D. In addition, each of the metamaterial units D can be a cube or a cuboid, and every metamaterial unit D can be identical blocks. The length, width and height of each substrate unit is less than one fifth of the incident electromagnetic wave length (typically, one tenth of the incident electromagnetic wave length) in order that the entire core layer could achieve continuous electric and magnetic field response. Preferably, the substrate unit V is a cube whose side length equals to one tenth of the incident electromagnetic wave length.

The refractive index is given by the following equation: $n=\sqrt{\mu\in}$, wherein $\mu$ is relative magnetic permeability and $\in$ is relative permittivity (collectively known as electromagnetic parameters). Experiments have proven that when travelling through a medium with refractive indexes unevenly distributed, electromagnetic waves will refract towards the direction with a larger refractive index (that is, towards the metamaterial unit with a larger refractive index). Therefore, the core layer of the present invention has an effect of converging electromagnetic waves. An appropriate design of the refractive index distribution of the core layer helps converge the electromagnetic waves emitted from the satellite to the feed through the core layer. When the materials of the substrate and filler layer are selected, the refractive index of each metamaterial unit can be designed based on the distribution of internal electromagnetic parameters of metamaterial by designing the shape and volume of the artificial pore structure 12' and/or the layout of the artificial pore structure 12' on the substrate. First, the spatial layout of internal electromagnetic parameters (that is, the electromagnetic parameters of each metamaterial unit) of the metamaterial is calculated according to the effects to be achieved by the metamaterial. Then, according to the calculated spatial layout of the electromagnetic parameters, the shape and volume (data of multiple artificial pore structures are stored in the computer beforehand) of the artificial pore structure 12' on each metamaterial unit are selected. Method of exhaustion can be used to design each metamaterial unit. For example, we choose an artificial pore structure with a specific shape, calculate its electromagnetic parameters and compare the calculation result with the desired one. This process is repeated until the desired electromagnetic parameters are found. If the desired electromagnetic parameters are found, selecting the design parameters of the artificial pore structure 12' is finished. Otherwise, another the artificial pore structure 12' with a different shape is selected instead. The above process is repeated until desired electromagnetic parameters are found. The above process will not stop if desired electromagnetic parameters are not found. That is, the program stops only when the artificial pore structure 12' with the desired electromagnetic parameters is found. As this process is executed by a computer, though seemed complex, it can be done quickly.

Figure 6:
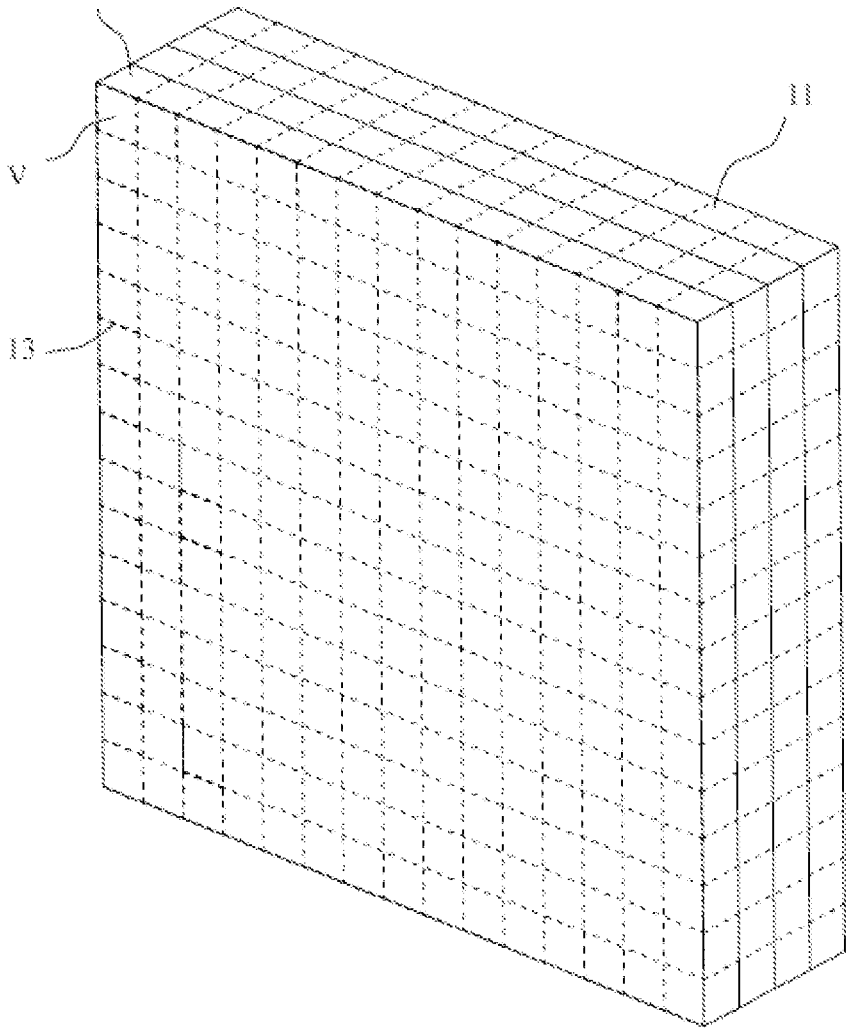
FIG. 6 is a schematic view of the structure of a third form of a core layer according to a first embodiment of the present invention.

Referring to FIG. 6, a core layer 10 in another form of the first embodiment of the present invention is shown. Each core sublayer 11 has a plurality of artificial pore structures 12' of the same shape. The plurality of artificial pore structures 12' are filled with a medium whose refractive index is smaller than that of substrate 13. The plurality of artificial pore structures 12' at the same radius in the circular area and annuli have the same volume. The volumes of the artificial pore structures 12' in each of the circular area and annuli gradually grow as the radius increases. The largest volume of the artificial pore structure 12' in the circular area is greater than the smallest volume of the artificial pore structure 12' in the annulus adjacent to the circular area. In two adjacent annuli, the largest volume of the artificial pore structure 12' in the inner annulus is greater than the smallest volume of the artificial pore structure 12' in the outer annulus. The artificial pore structure 12' is filled with a medium whose refractive index is smaller than that of the substrate. Therefore, the larger the volume of the artificial pore structure 12', the more media are required to fill the artificial pore structure 12', the smaller of the corresponding refractive index will be. Therefore, in this way, the refractive indexes of the core sublayers can be distributed according to equation (1).

The Core layers as shown in FIG. 5 and FIG. 6 have the same appearance and refractive index distribution, but they are different in the way for achieving the above-mentioned refractive index distribution (because the filler media are different). The core layer 10 as shown in FIG. 5 and FIG. 6 both have a 4-layer structure, but the 4-layer structure is for demonstration purpose only. The core layer may have different layers depending on different needs (different incident electromagnetic waves) and actual design requirements.

Certainly, the core layer 11 is not limited to the above two forms. For example, each artificial pore structure 12' may comprise a plurality of unit pores with equal volumes. The same purpose can also be achieved by controlling the volume of each artificial pore structure 12' on each metamaterial unit D through the number of unit pores on each substrate unit V. For another example, the core layer 11 can be in the following form, i.e. all artificial pore structures of the same core sublayer have the same volume but the refractive index of the filler layer satisfies equation (1).

As a substitution, in the first embodiment of the present invention, 1 in the refractive index n(r) distribution equation of the core layer 11 indicates the distance from the feed to the core layer (in the first embodiment, 1 indicates the distance from the feed to its adjacent matching layer). The substrate of the core layer is made from ceramic material, polymer material, ferroelectric material, ferrite material or ferromagnetic material, etc. The polymer material can be selected from the group comprising of PTFE, epoxy resin, F4B composite materials, FR-4 composite materials and so on. For example, PTFE, with excellent electrical insulating property, produces no interference to the electric field of electromagnetic waves. Furthermore, PTFE has excellent chemical stability, corrosion resistance and a long service time.

Referring to FIG. 8 to FIG. 14, a Cassegrain satellite television antenna of a second embodiment of the present invention, on the basis of the first embodiment of the present invention, further comprises a diverging component 200 capable of diverging electromagnetic waves. The diverging component 200 is located in front of the feed 1 and between the feed and the metamaterial plate 100.

Figure 9:
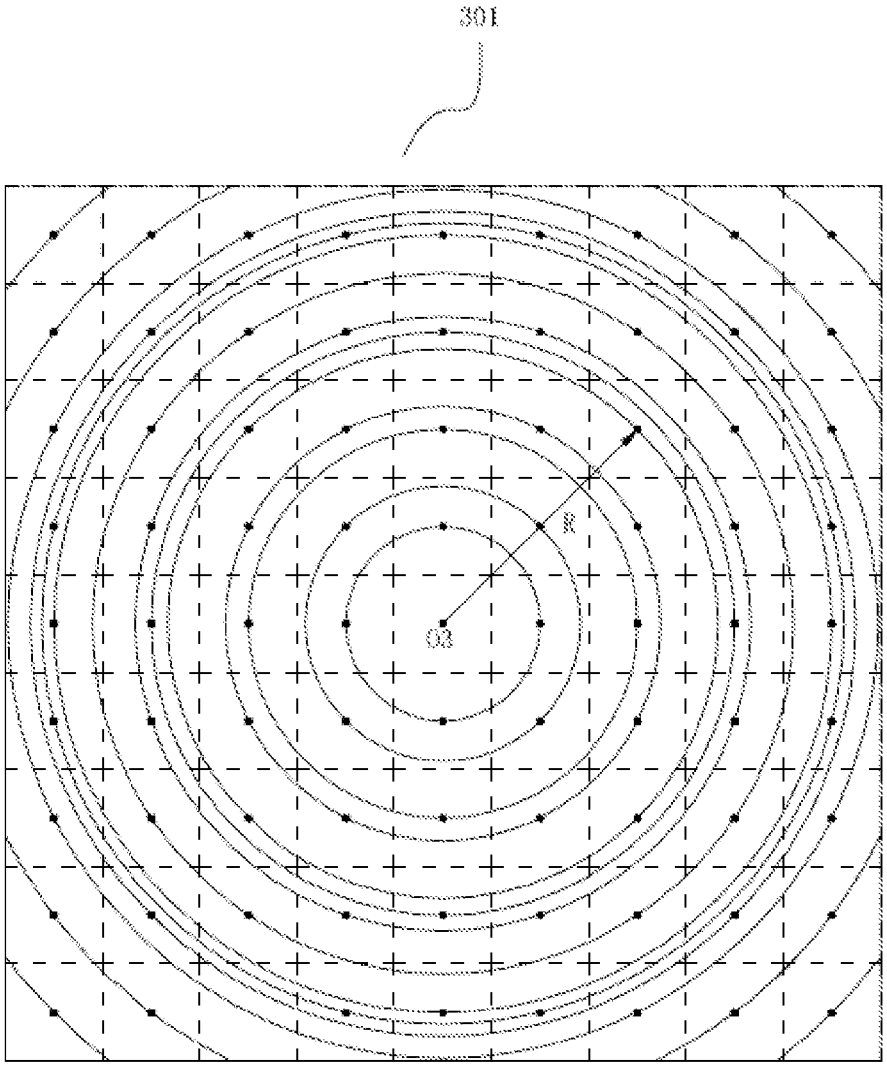
FIG. 9 is a schematic view of the refractive index distribution of a diverging sublayer according to a second embodiment of the present invention.
Figure 12:
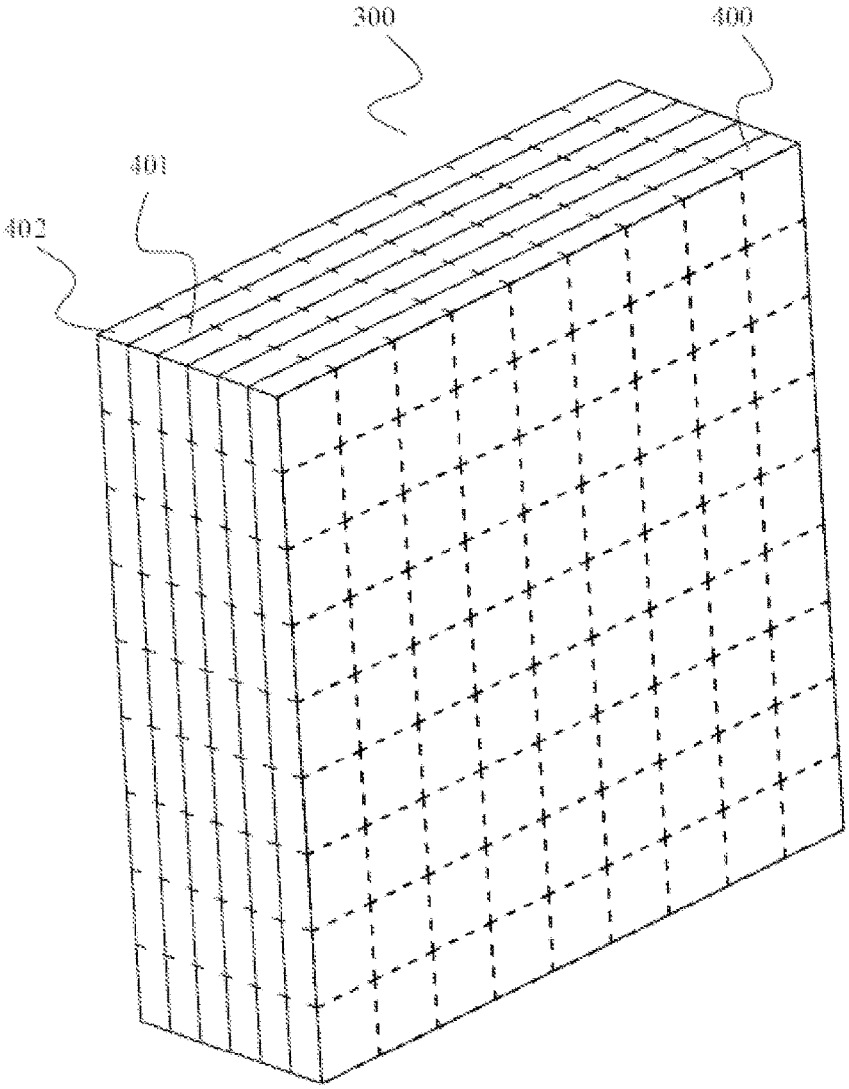
FIG. 12 is a schematic view of the structure of the diverging metamaterial plate with diverging sublayers as shown in FIG. 10.
Figure 14:
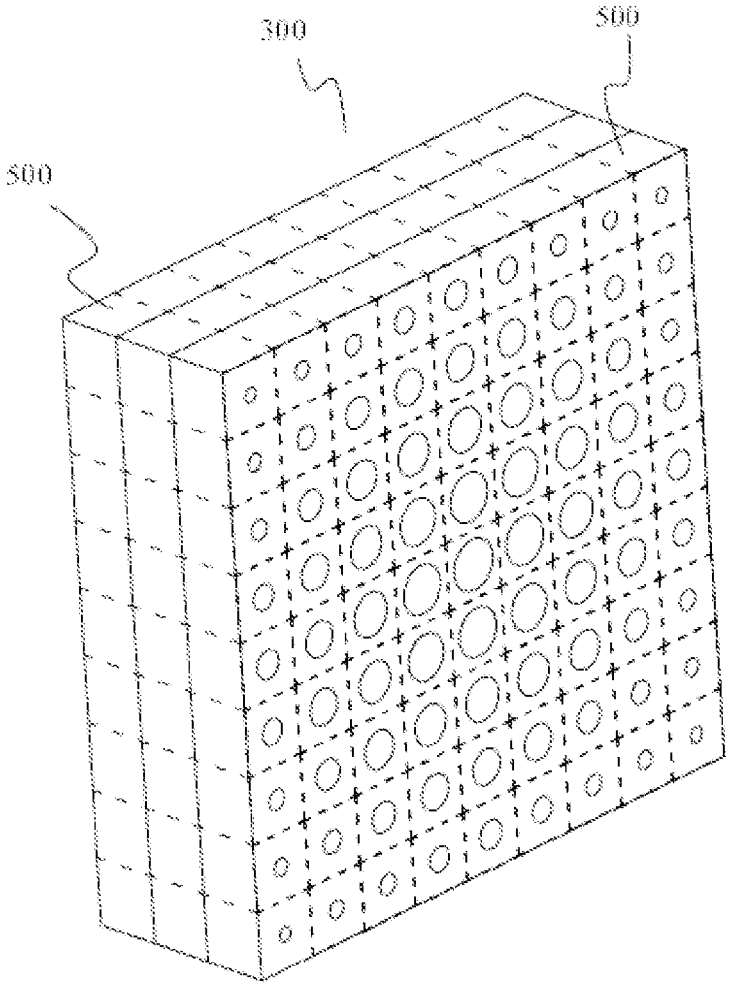
FIG. 14 is a schematic view of the structure of the diverging metamaterial plate with diverging sublayers as shown in FIG. 13.

The diverging component 200 can be a concave lens or the diverging metamaterial plate 300 as shown in FIG. 12 and FIG. 14. The diverging metamaterial plate 300 comprises at least one diverging sublayer 301. The refractive index of the diverging sublayer 301 is shown in FIG. 9. The refractive indexes of the diverging sublayer 301 are circularly distributed around the center O3 and the refractive indexes of points at the same radius are the same and gradually decrease as the radius increases. The diverging component capable of diverging electromagnetic waves arranged between the metamaterial plate and the feed has the following effects: that is, under the circumstances that the range for the feed to receive electromagnetic waves is constant (i.e. the range for the metamaterial plate to receive electromagnetic wave radiation is constant), comparing with no diverging component is used, the distance between the feed and the metamaterial plate decreases, therefore greatly decreasing the antenna volume.

The refractive index distribution of diverging sublayer 301 can change linearly, i.e. $n_R=n_{min}+KR$, wherein K is a constant, R is the radius (with the center O3 of the diverging sublayer 301 as the center) and $n_{min}$ is the minimum refractive index of the diverging sublayer 301. That is, the refractive index of the diverging sublayer 301 at the center O3. Besides, the refractive index distribution of the diverging sublayer 301 may also change in a square law, i.e. $n_R=n_{min}+KR^2$, or in a cube law, i.e. $n_R=n_{min}+KR^3$, or in a power function, i.e. $n_R=n_{min}*K^R$.

Figure 10:
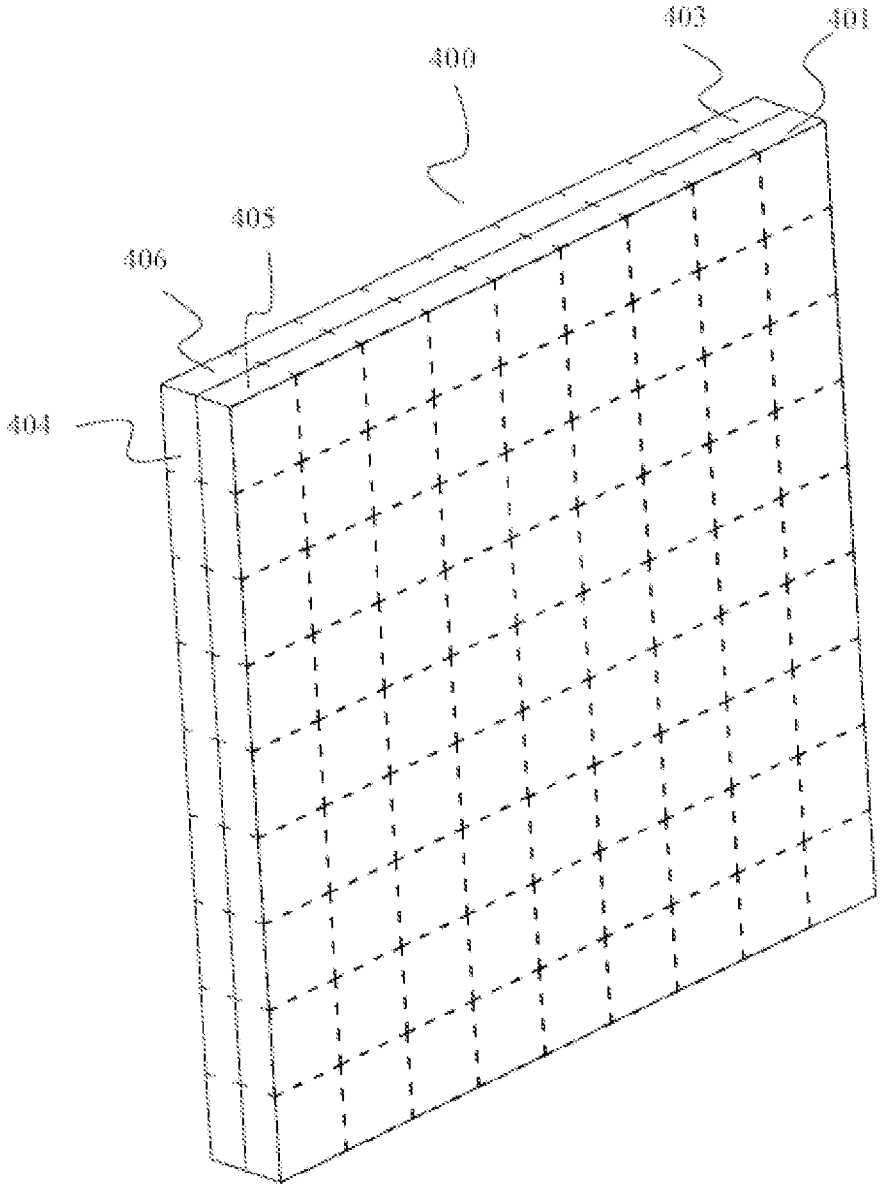
FIG. 10 is a schematic view of the structure of a form of a diverging sublayer according to a second embodiment of the present invention.
Figure 11:
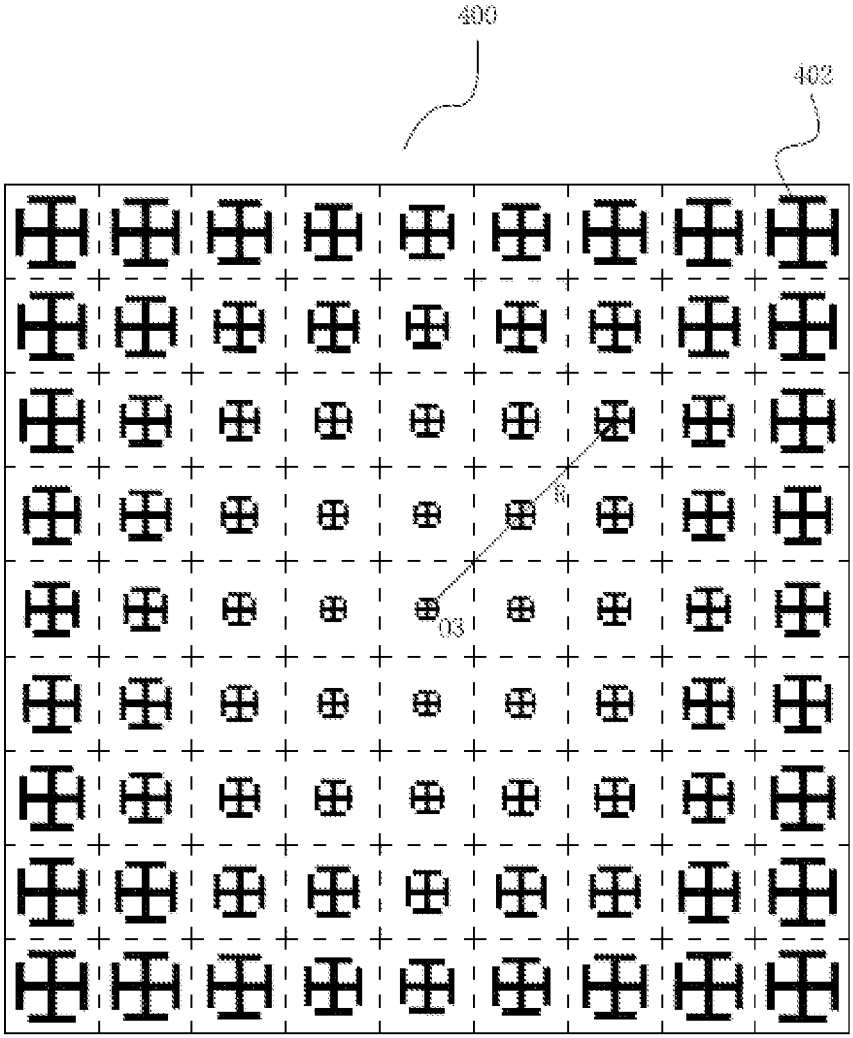
FIG. 11 is a front view of FIG. 10 with the substrate removed.

FIG. 10 shows one form of a diverging sublayer 400 that achieves the refractive index distribution as shown in FIG. 9. As shown in FIG. 11 and FIG. 10, the diverging sublayer 400 comprises a slice-shaped substrate 401, a metal microstructure 402 attached on the substrate 401 and a supporting layer 403 covering the metal microstructure 402. The diverging sublayer 400 can be divided into a plurality of identical first diverging units 404. Each first diverging unit comprises a metal macrostructure 402, and its occupied substrate unit 405 and supporting layer unit 406. Each diverging layer 400, in the thickness direction, comprises only one first diverging unit 404. All first diverging units 404 can be identical blocks with shapes such as cubes or cuboids. The length, width and height of each first diverging unit 404 are not greater than one fifth of the incident electromagnetic wave length (usually one tenth of the incident electromagnetic wave length), thereby allowing the whole diverging layer to have a continuous electric field and/or magnetic field response to electromagnetic waves. Preferably, the first diverging unit 404 is a cube whose side length is one tenth of the incident electromagnetic wave length. Preferably, the structure of the first diverging unit 404 of the present invention is the same as that of the metamaterial unit D shown in FIG. 2.

FIG. 11 is the front view of the diverging sublayer 400 as shown in FIG. 10 but without the substrate. The spatial layout of the plurality of metal microstructures 402 with the center O3 (at the center of the middlemost metal microstructure) serving as the center of diverging sublayer 400 can be clearly seen in FIG. 11. The metal microstructures 402 at the same radius have the same geometric size. As the radius increases, the geometric size of the metal microstructure 402 decreases gradually. The radius here refers to the distance between the center of each metal microstructure 402 and the center O3 of the diverging sublayer 400.

The substrate 401 of the diverging sublayer 400 is made from ceramic material, polymer material, ferroelectric material, ferrite material or ferromagnetic material. The polymer material can be selected from the group comprising of PTFE, epoxy resin, F4B composite materials, FR-4 composite materials and so on. For example, PTFE, with excellent electrical insulating property, produces no interference to the electric field of electromagnetic waves. Furthermore, PTFE has excellent chemical stability, corrosion resistance and a long service time.

The metal microstructure 402 is made from metal wires such as copper wires or silver wires. These metal wires can be attached to the substrate by employing such methods as etching, plating, drilling, photolithography, electronic engraving or ion engraving. Certainly, three-dimensional laser processing technique can also be adopted. The metal microstructure 402 can be a planar snowflake-shaped metal microstructure as shown in FIG. 11. Certainly, the metal microstructure 402 can also be a derivative structure of a planar snowflake-shaped metal microstructure. The metal microstructure 402 can also be made from metal wires processed into an H shape or a cross shape.

FIG. 12 shows the diverging metamaterial plate 300 formed by using a plurality of diverging sublayers 400 as shown in FIG. 10. The diverging sublayer 400 has three layers as shown in FIG. 10. Certainly, the diverging metamaterial plate 300 may comprise diverging sublayers 400 of varied numbers depending on various needs. The diverging sublayers 400 can be attached to each other by using a double-sided tape or fastened together by using bolts. In addition, the matching layers as shown in FIG. 7 are arranged on both sides of the diverging metamaterial plate 300 as shown in FIG. 12 to match refractive indexes, reduce reflection of electromagnetic waves and enhance signal reception.

Figure 13:
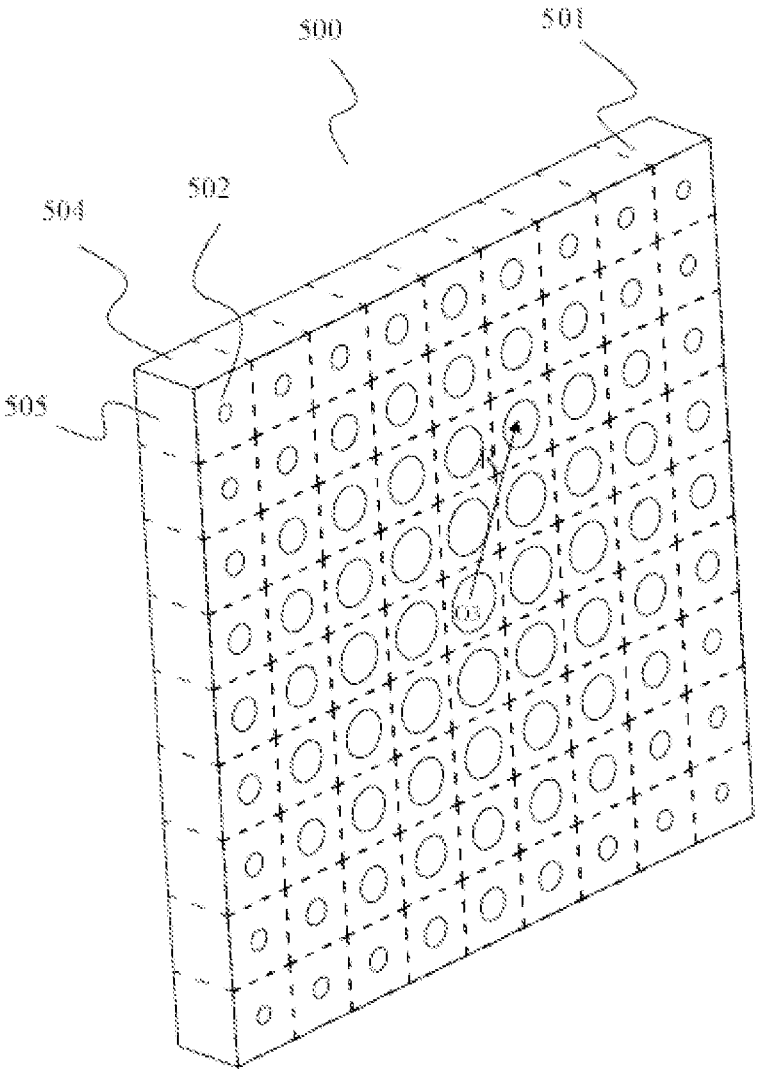
FIG. 13 is a schematic view of the structure of a second form of a diverging sublayer according to a second embodiment of the present invention.

FIG. 13 shows another form of diverging sublayer 500 that achieves the refractive index distribution as shown in FIG. 9. The diverging sublayer 500 comprises a slice-shaped substrate 501 and an artificial pore structure 502 attached on the substrate 501. The diverging sublayer 500 can be divided into a plurality of identical second diverging units 504. Each second diverging unit 504 comprises a artificial pore structure 502 and an its occupied substrate unit 505. Each diverging layer 500, in the thickness direction, comprises only one second diverging unit 504. All first diverging units 504 can be identical blocks with shapes such as cubes or cuboids. The length, width and height of each second diverging unit 504 are not greater than one fifth of the incident electromagnetic wave length (usually one tenth of the incident electromagnetic wave length), thereby allowing the whole diverging layer to have a continuous electric field and/or magnetic field response to electromagnetic waves. Preferably, the second diverging unit 504 is a cube whose side length is one tenth of the incident electromagnetic wave length.

As shown in FIG. 13, the artificial pore structure on the diverging sublayer 500 is cylindrical. With the center O3 of the diverging sublayer 500 serving as the center (center O3 here is on the central axis of the middlemost artificial pore structure), The artificial pore structures 502 at the same radius have the same volume, and as the radius increases the volume of the artificial pore structure 402 decreases gradually. The radius here refers to the distance between the central axis of each artificial pore structure 502 and the central axis of the middlemost artificial pore structure of the diverging sublayer 500. When each cylindrical pore is filled with medium material (air for example) with a refractive index less than that of the substrate, the refractive index distribution as shown in FIG. 9 can be realized. Certainly, if taking center O3 of diverging sublayer 500 as the center, the artificial pore structures 502 on the same radius have the same volume, and as the radius increase so does volumes of the artificial pore structure 402. Under this circumstance, each cylindrical pore needs to be filled with medium material with larger refractive index than that of the substrate to realize the refractive distribution as shown in FIG. 9.

Certainly the diverging sublayer is not limited to the above two forms. For example, each artificial pore structure can be divided into a certain number of unit pores with a same volume. To adjust the volume of the artificial pore structure on the second diverging unit by the quantity of the unit pores on each substrate unit can work as well. For another example, the diverging sublayer can be formed as below, i.e. all artificial pore structures of the same diverging sublayer have the same volume. Yet its refractive index conforms to the distribution in FIG. 9, in which the refractive indexes of the filler media on the same radius are the same, and as the radius increases the refractive indexes of filler media gradually decrease.

Substrate 501 of the diverging sublayer 500 is made from ceramic material, polymer material, ferroelectric material, ferrite material or ferromagnetic material. The polymer materials can be selected from the group comprising of PTFE, epoxy resin, F4B composite materials, FR-4 composite materials and so on. For example, PTFE, with excellent electrical insulating property, produces no interference to the electric field of electromagnetic waves. Furthermore, PTFE has excellent chemical stability, corrosion resistance and a long service time.

The artificial pore structure 502 can be formed on the substrate through high-temperature sintering, injection molding, stamping or NC drilling. Certainly, method for making the artificial pore structures can vary with substrates made of different materials. For example, when a ceramic material is selected as the substrate, high-temperature sintering is preferred to form the artificial pore structures on the substrate. When a polymer material such as PTFE and epoxy resin is selected to form the substrate, injection molding or stamping is preferred to form artificial pore structures on the substrate.

The above artificial pore structure 502 can be cylindrical, cone, trapezium, square or a combination of shapes selected from them. Certainly, it can also be other shapes. The artificial pore structures on the second diverging unit can be the same or different depending on varied needs. Certainly, to simplify processing and manufacturing, preferably, the same shape is adopted for the whole metamaterial.

FIG. 14 shows the diverging metamaterial plate 300 formed by a plurality of diverging sublayer 500 as shown in FIG. 13. The diverging metamaterial plate 300 has three layers as shown in FIG. 14. Certainly, the diverging metamaterial plate 300 may comprise other number of layers of diverging sublayers 500 depending on various needs. The diverging sublayers 500 can be attached to each other by using double-sided tapes or fastened together by using bolts. In addition, the matching layers as shown in FIG. 7 are arranged on both sides of diverging metamaterial plate 300 as shown in FIG. 14 to match refractive indexes, reduce reflection of electromagnetic waves and enhance signal reception.

Besides, the present invention also provides a satellite television receiving system comprising a feed, a low-noise block downconverter (LNB) and a satellite receiver. The satellite television receiving system also comprises the above-mentioned Cassegrain satellite television antenna. The Cassegrain satellite television antenna is set in front of the feed.

The feed, LNB and satellite receiver are prior art and are not described here.

The embodiments of the present invention are described with reference to the drawings. But the present invention is not limited to the embodiments of the present invention, which are only demonstrative rather than restrictive. Without departing from the spirit of the present invention and the scope of claims protection, the skilled in this art, inspired by the present invention, can make a plurality of forms which are all under the protection of the present invention.

What is claimed is:

1. A Cassegrain satellite television antenna, the Cassegrain satellite television antenna comprises a metamaterial plate which is located in front of a feed, the metamaterial plate comprising a core layer, the core layer comprising at least one core sublayer, the core sublayer comprising a sheet-like substrate and a plurality of artificial pore structures located on/in the substrate, the core sublayer being divided into two parts according to refractive index distributions, with one part being a circular area which is in the center of the core sublayer, and the other part being a plurality of annuli areas which are distributed around and share the same center with the circular area, the refractive indexes of points at the same radius in the circular area and the annuli area being the same and decreasing with the increase of the radius, the minimum value of the refractive index in the circular area being smaller than the maximum value of the refractive index in the adjacent annulus, and in two adjacent annuli area, the minimum value of the refractive index in the inner annulus being smaller than the maximum value of the refractive index in the outer annulus, characterized in that, the artificial pore structures of each core sublayer are of the same shape, the artificial pore structures being filled with a medium whose refractive index is smaller than that of the substrate, the artificial pore structures of the points at the same radius in the circular area and annuli area being of the same volume and the volumes of the artificial pore structures of the points gradually decreasing as the radius of the points increases in circular area or annuli area, the volume of the maximum artificial pore structure in the circular area being larger than that of the minimum artificial pore structure in the adjacent annulus, and in two adjacent annuli area, the volume of the maximum artificial pore structure in the inner annulus being larger than that of the minimum artificial pore structure in the outer annulus.

2. The Cassegrain satellite television antenna defined in claim 1, characterized in that, the artificial pore structure is a cylindrical pore.

3. The Cassegrain satellite television antenna defined in claim 1, characterized in that, the Cassegrain satellite television antenna further comprises a diverging component located in front of the feed which is capable of diverging electromagnetic waves, and the metamaterial plate is located in front of the diverging component.

4. A Cassegrain satellite television receiving system comprising a feed, characterized in that, the Cassegrain satellite television receiving system further comprises a Cassegrain satellite television antenna, the Cassegrain satellite television antenna is the Cassegrain satellite television antenna defined in claim 1, the Cassegrain satellite television antenna being located in front of the feed.

* * * * *